US006285341B1

(12) United States Patent
Roscoe et al.

(10) Patent No.: US 6,285,341 B1
(45) Date of Patent: Sep. 4, 2001

(54) LOW PROFILE MOBILE SATELLITE ANTENNA

(75) Inventors: David Roscoe, Dunrobin; Michael Cooper, Gloucester, both of (CA)

(73) Assignee: Vistar Telecommunications Inc., Ottawa (CA)

( * ) Notice: Subject to any disclaimer, the term of this patent is extended or adjusted under 35 U.S.C. 154(b) by 0 days.

(21) Appl. No.: 09/368,174

(22) Filed: Aug. 4, 1999

Related U.S. Application Data

(60) Provisional application No. 60/095,386, filed on Aug. 5, 1998.

(30) Foreign Application Priority Data

Aug. 4, 1998 (CA) ..... 2244407

(51) Int. Cl.[7] ..... H01Q 1/36
(52) U.S. Cl. ..... 343/895; 343/859
(58) Field of Search ..... 343/895, 866, 343/867, 741, 765, 859, 872, 742, 744, 748, 743, 788, 870

(56) References Cited

U.S. PATENT DOCUMENTS 4,489,276 * 12/1984 Yu ..... 324/338
4,494,117 * 1/1985 Coleman ..... 343/365
5,734,353 * 3/1998 Van Voohies ..... 343/742
5,896,113 * 4/1999 O'Neill, Jr. ..... 343/895
6,011,524 * 1/2000 Jervis ..... 343/895
6,028,558 * 2/2000 Van Voorhies ..... 343/742

FOREIGN PATENT DOCUMENTS 97 41695 11/1997 (WO) .
98 15028 4/1998 (WO) .
98 15029 4/1998 (WO) .

OTHER PUBLICATIONS

Hisamatsu Nakano et al: "Extremely Low–Profile Helix Radiating A Circularly Polarized Wave" IEEE Transactions On Antennas and Propagation, US, IEEE Inc. New York, vol. 39, No. 6, p. 754–757 XP000209548 ISSN: 0018–926X—the whole document.

* cited by examiner

*Primary Examiner*—Don Wong
*Assistant Examiner*—Chuc Tran
(74) *Attorney, Agent, or Firm*—Marks & Clerk

(57) ABSTRACT

A low profile antenna with high gain at low elevations suitable for satellite communications consists of a helical loop with turns tightly spaced to provide a strong coupling therebetween. The pitch is typically 1 to 2 degrees. The helical loop behaves like a travelling-wave loop antenna.

19 Claims, 4 Drawing Sheets

LOW PROFILE MOBILE SATELLITE ANTENNA

CROSS REFERENCE TO RELATED APPLICATIONS

This application claims priority under 35 USC 119(e) from U.S. provisional application No. 60/095,386 filed Aug. 5, 1998.

FIELD OF THE INVENTION

The invention relates to a low profile antenna, and more particularly to a mobile antenna suitable for satellite communications.

BACKGROUND OF THE INVENTION

In the last thirty years satellite services have come to play an increasingly important role in telecommunications. Antenna design is an important part of a satellite system. One type of satellite antenna suitable for satellite communications is the quadrifilar helix first disclosed by Kilgus (Resonant Quadrifilar Helix Design, Microwave Journal, December 1970). This antenna consists of four helical windings fed in phase quadrature.

This configuration exhibits many performance characteristics well suited to satellite communications, namely, a hemispherical omnidirectional radiation pattern with excellent circular polarization throughout the radiation pattern, as well as compactness and simplicity. Omnidirectional coverage is desirable to allow the earth terminal to see the satellite regardless of its relative orientation to the satellite. The geometries of this design employ a resonant matching network. Hence the operating bandwidth is typically narrow.

Recently, higher performance mobile satellite services have emerged which require increased antenna gain. Due to the location of population of the earth, the areas that many service providers have allocated high priority to are in the northern hemisphere. As a result the important converge profile is located at 20 to 60 degrees in elevation with respect to the earth terminal.

In prior art, the increase in gain at these elevations is accomplished by increasing the height of the quadrifilar helix antenna. The compact quadrifilar helix antenna, which can exhibit nearly uniform hemispherical gain, does not provide enough gain at 20 to 45 degrees in elevation for the high performance systems. More energy can be directed to the low elevation angles by increasing the height of the antenna. The tradeoff between size and performance leads to a significant increase in the height of the antenna. As low profile structures are highly desirable for mobile communications, this is a considerable disadvantage.

An object of the invention is to overcome this disadvantage.

SUMMARY OF THE INVENTION

According to the present invention there is provided a low profile antenna comprising a helical loop having a plurality of turns, said turns being closely spaced so as to provide a strong coupling therebetween and thereby force the current in said closely spaced turns to be in phase.

since the current on all the turns of the loop is forced to be phase due to the strong coupling, each of the turns of the loop behaves like a travelling wave antenna.

By modeling the helical loop antenna on the basis of the travelling-wave loop antenna operation, the radiation properties of higher order modes of the loop antenna can be exploited to direct the radiated energy of the helical loop antenna towards low elevation angles. The multiple turns of the helical loop antenna eliminate the need for a matched load on the end of the wire, increasing the radiation efficiency and thus the gain of the antenna.

The antenna is primarily intended for satellite communications, but it could be used for other applications where high gain in the 20 to 60 degree elevation is desired.

The invention eliminates the need to trade-off height for the low elevation angle coverage required by mobile satellite antenna systems. This is accomplished with the use of a helical loop that is short in height but large in diameter.

BRIEF DESCRIPTION OF THE DRAWINGS

Referring now to FIG. 1, this shows a prior art resonant quadrifilar helix antenna consisting of four end-fed helical antenna elements 1. The antenna is fed from a 3 db directional coupler 2 through identical matching impedance networks 3.

Figure 1:
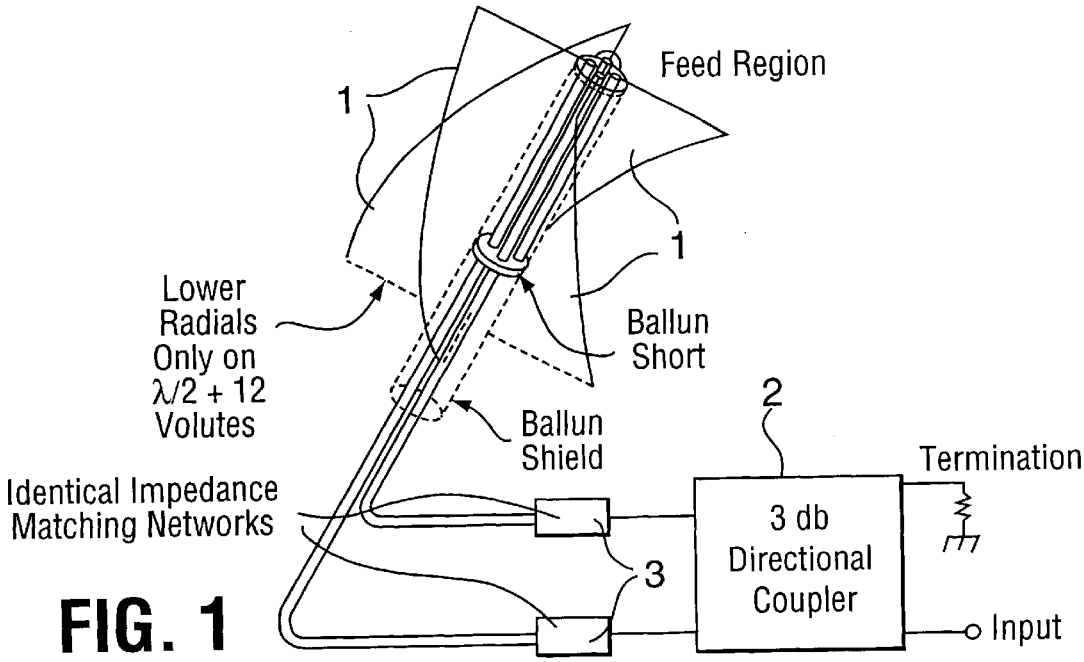
FIG. 1 shows a prior art quadrifilar helix antenna.
Figure 2:
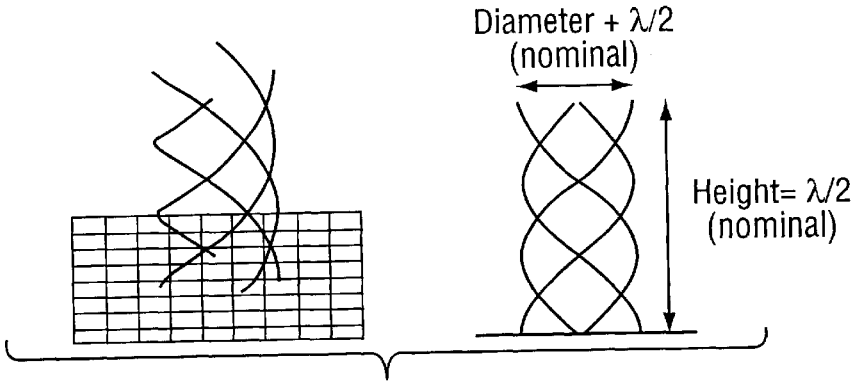
FIG. 2 shows the typical geometry of a quadrifilar helix antenna for hemispherical coverage.

For uniform hemispherical coverage, the quadrifilar helix antenna typically has the geometry shown in FIG. 2. The diameter is nominally $\lambda/5$, where $\lambda$ is the wavelength of the radiation, and the height is nominally $\lambda/2$. For mobile systems, such an antenna does not exhibit sufficient gain at 20 to 45 degrees elevation for high performance systems.

Figure 3:
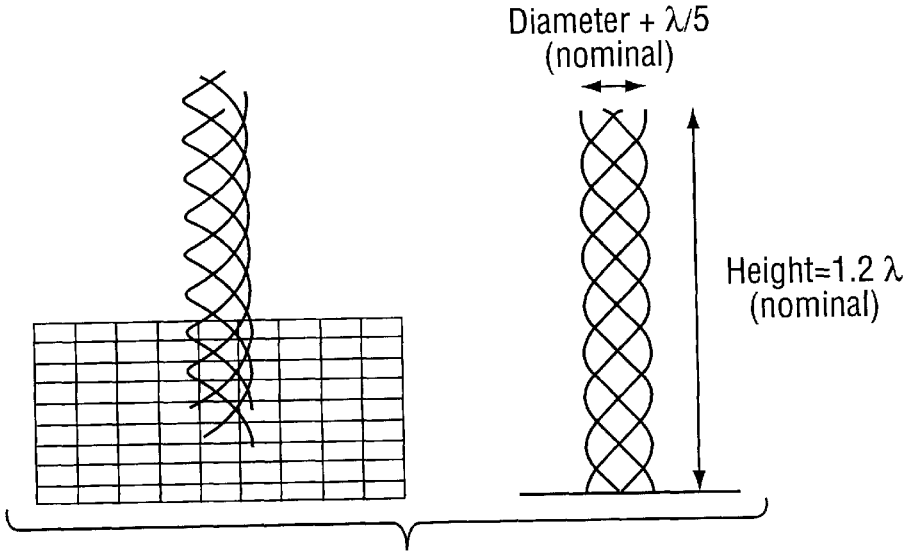
FIG. 3 shows the typical geometry of a quadrifilar helix antenna for hemispherical coverage.

More energy can be directed to the low elevation angles by increasing the height of the antenna as shown in FIG. 3, where the diameter remains $\lambda/5$ but the height has been increased to $1.2\lambda$. For a 1500 MHz signal, this works out to be about 24 cms. Since low profile structures are highly desirable for mobile communications, this increased height is a considerable disadvantage of the quadrifilar design.

Figure 4:
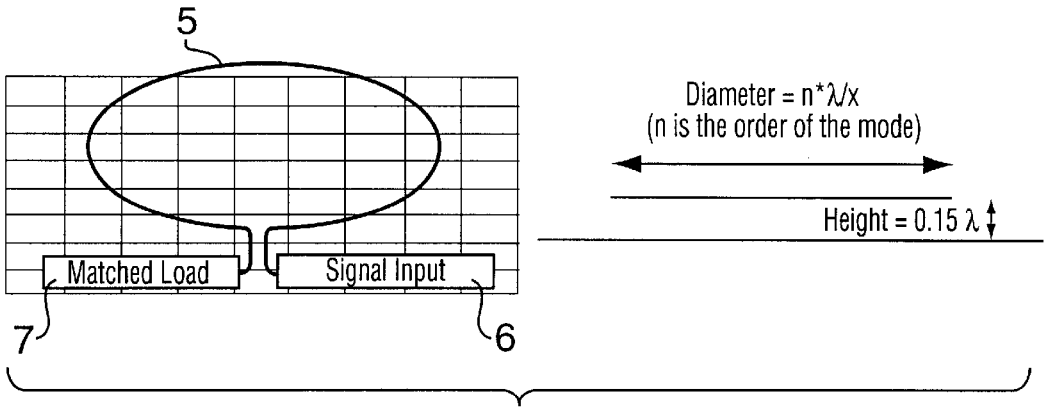
FIG. 4 shows the typical geometry of a travelling wave loop antenna.
Figure 5:
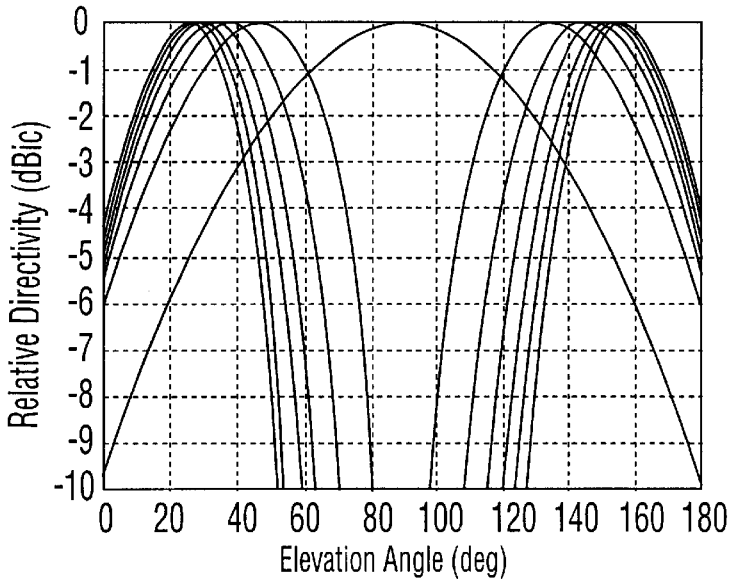
FIG. 5 shows the radiation patterns for modes of traveling-wave loop antenna.

Another type of known antenna is the travelling wave loop antenna. This consists of a wire 5 bent to a form a planar loop as shown in FIG. 4. The signal is injected into one end 6 of the wire. A matched load 7 is placed at the other end. In this design, the radiation efficiency is reduced by the fact that energy is absorbed by the load 7 at the end of the wire. The loop radiates circularly polarized radiation if the circumference of the loop is an integer multiple of one wavelength. The integer value is termed the 'mode' of the loop. For modes equal to or greater than two the radiated energy is directed away from zenith towards low elevation angles. The radiation pattern for each 'mode' of operation can be analytically determined. The radiation patterns for the first seven modes are plotted in FIG. 5. For modes greater than one, the antenna exhibits good gain in the 20 to 60 degree range.

Figure 6:
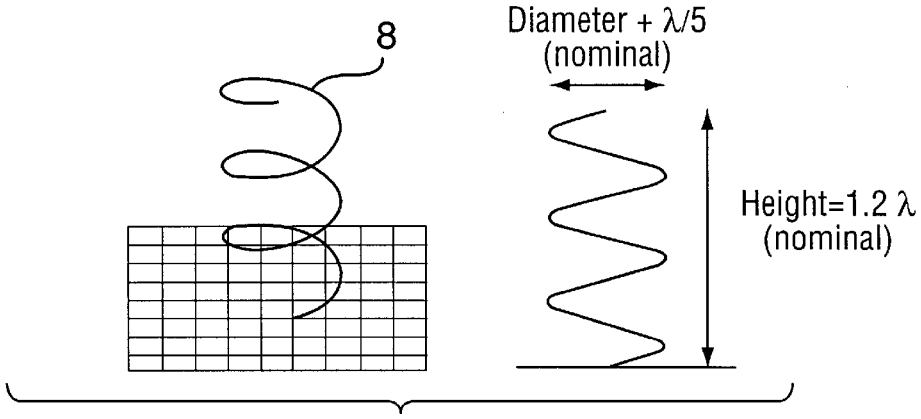
FIG. 6 shows the typical geometry of an end-fire helix antenna.

Another type of antenna is the helix antenna, which is shown in FIG. 6. This is also a travelling wave antenna made of a single wire wound in the form of a helix 8. The helix 8 has three or more turns with a pitch angle of approximately 14 degrees. The spacing between the turns is approximately a quarter of a wavelength and the circumference is approximately equal to a wavelength. The radiation form each turn adds in phase with the radiation from the next turn creating a travelling wave along the antenna. The helix antenna can have better radiation efficiency than the travelling-wave loop antenna because with the helix antenna there is no energy dissipated in a load. The helix antenna with the dimension outline above radiates a circularly polarized wave directed on axis (end-fire), where the directivity increases with the height of the antenna as per standard helix antenna theory.

Figure 7:
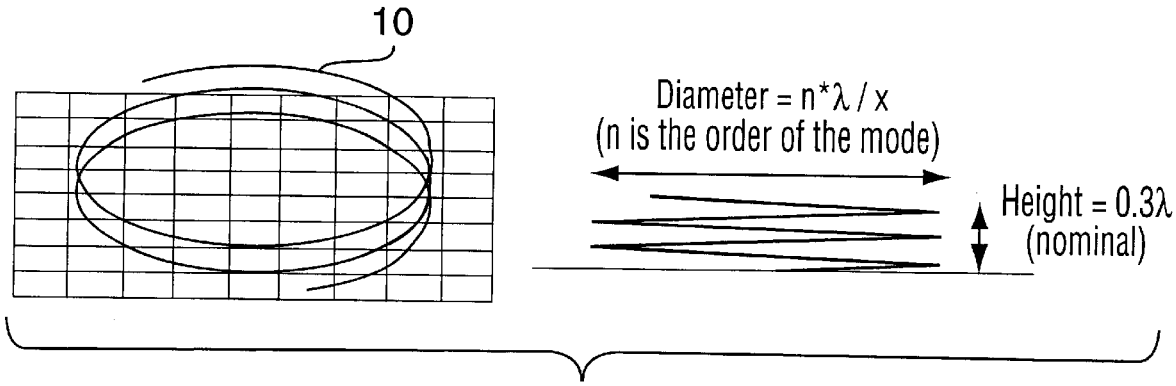
FIG. 7 shows a helical loop antenna in accordance with one embodiment of the invention.

An antenna made in accordance with the principles of the invention is shown in FIG. 7. This antenna is made of about 2½ turns of a single wire 10 in the form of a helix but with only 1 to 2 degrees of pitch angle. The tight spacing of the turns of the helical loop antenna results in much stronger coupling between the turns of the helical loop antenna than for the helix antenna. The current on all the turns of the helical loop antenna is thus forced to be in phase due to the strong coupling between the turns. As a result each of the turns of the helical loop antenna behaves like a travelling-wave loop antenna.

By modeling the helical loop antenna on the basis of the travelling-wave loop antenna operation, the radiation properties of higher order modes of the loop antenna can be exploited to direct the radiated energy of the helical loop antenna towards low elevation angles. But as with the helix antenna, the multiple turns of the helical loop antenna eliminate the need for a matched load on the end of the wire, increasing the radiation efficiency and thus the gain of the antenna.

Helical loop antennas of mode 3 and mode 4 yielded excellent low elevation angle coverage results. The diameter of the loop is given by the expression $D=n*\lambda/\pi$, where n is the order of the mode. The corresponding diameters are thus in the order of 19 and 25 cms at L-band frequencies.

The helical loop antenna has a height of only 0.2 to 0.4 of a wavelength, which for a 1500 MHz signal is only about 4 to 8 cms. This compares favourably with quadrifilar helix antenna for low elevation angle coverage, which has a height of more than one wavelength, or more than 20 cms. at 1500 MHz.

Figure 10:
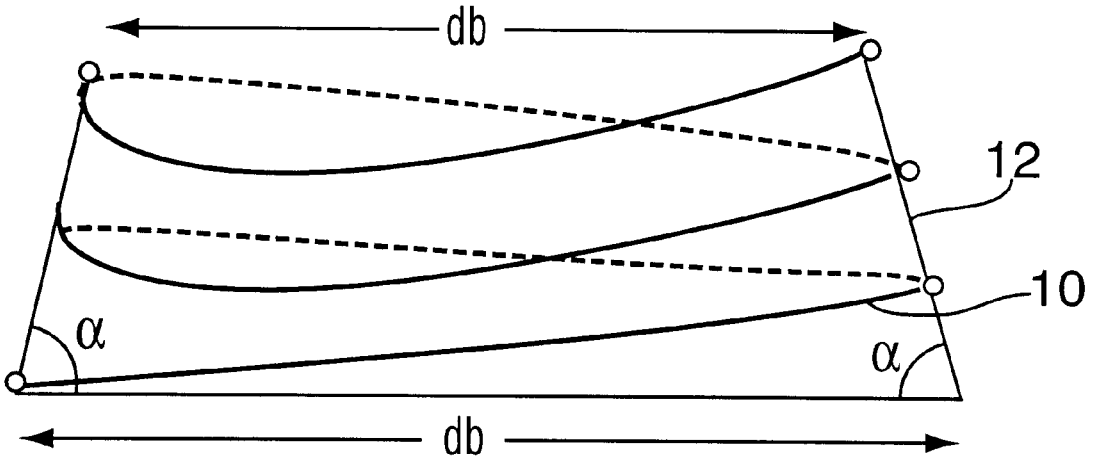
FIG. 10 shows a second embodiment of a part of an antenna in accordance with the invention.

In FIG. 10, the helical antenna 10 is wound around an imaginary frusto-conical surface 12 having an inclination $\alpha$, which may typically be in the order of 10 to 20 . The height of the antenna is shown grossly exaggerated for the purposes of illustration. The angle $\alpha$ is a function of the operational frequencies and is chosen such that the bottom diameter of the antenna $d_b$ is turned to the lowest frequency to be received and the top diameter $d_t$ is tuned to the highest frequency. The inclination of the imaginary walls of the loop antenna broadens the frequency bandwidth of the device.

Figure 11:
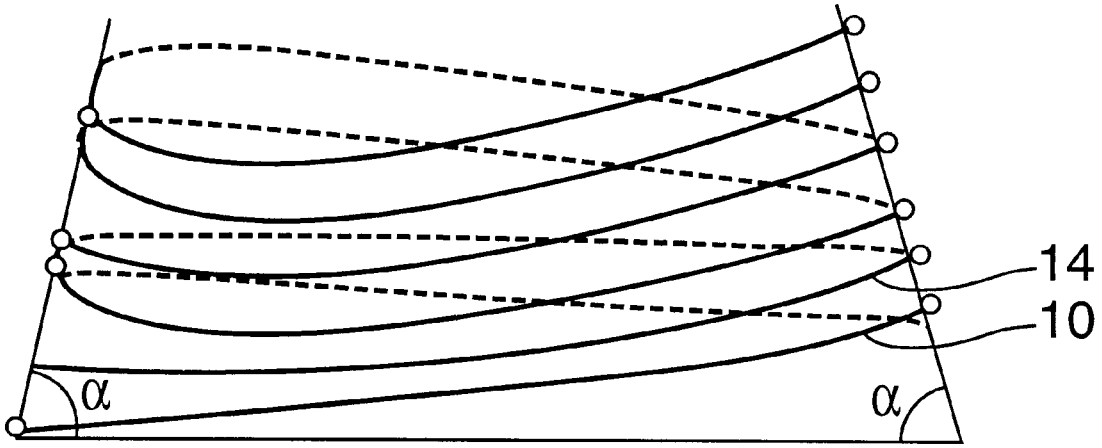
FIG. 11 shows a third embodiment of a part of an antenna in accordance with the invention.

In a still further embodiment shown in FIG. 11, a second antenna 14 is interleaved with the first antenna 10 on the imaginary cone. The second antenna is fed through a splitter (not shown) and designed such that the current is in phase with the current in the first antenna 10. This produces a more uniform current distribution about the antenna, thus decreasing the antenna gain as a function of azimuth angle $\phi$. Four loops interleaved in this manner can also be employed.

EXAMPLE

A mobile satellite helical loop antenna was fabricated as described above for mode 4. The design frequencies were:

Satellite RX: 1525–1575.42 MHz

Satellite TX: 1610–1660.5 MHz

Figure 8:
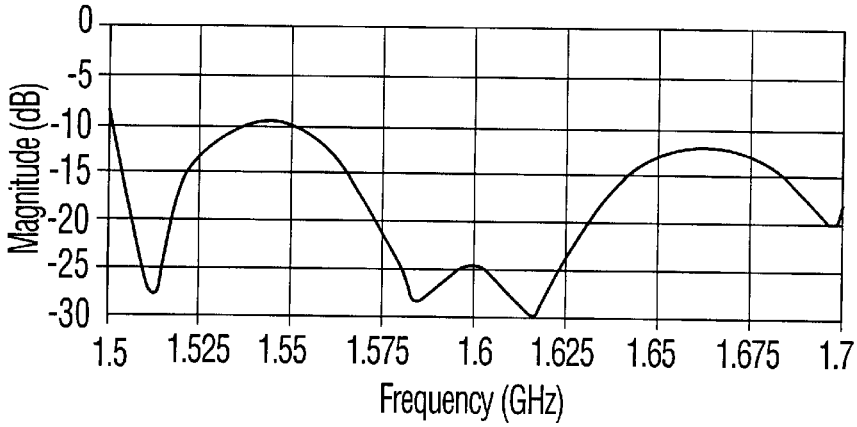
FIG. 8 shows the return loss of the helical loop antenna.
Figure 9:
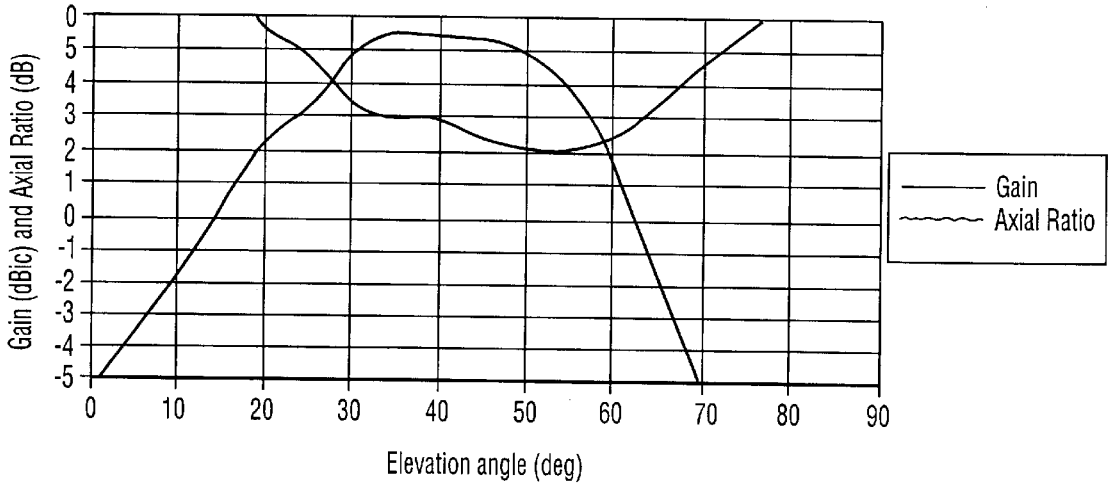
FIG. 9 shows the radiation performance of the helical loop antenna.

The measured results are shown in FIGS. 8 and 9. FIG. 9 shows the antenna gain is above about 2 dB in the 20 to 60 degree range, while the return loss (FIG. 8) is under −10 dB over the frequency range of interest.

The described mobile satellite antenna has the advantages of low profile and high performance as compared to traditional mobile satellite antenna solutions. It combines in a synergistic manner the properties of a traditional travelling wave antenna and a helical loop antenna to achieve a hitherto unattainable result.

What is claimed is:

1. A low profile antenna comprising an antenna element consisting of a single helical loop having multiple overlapping turns without a matching load at one end of the loop, said multiple overlapping turns being closely spaced so as to provide a sufficiently strong coupling between adjacent said overlapping turns of said helical loop to force the current in all of said overlapping turns to be in phase such that each turn of said helical loop behaves as a traveling-wave loop antenna.

2. A low profile antenna as claimed in claim 1, wherein the pitch angle of said helical loop is about 1 to 2 degrees.

3. A low profile antenna as claimed in claim 2, wherein the diameter of the helical loop is given by the expression $D=n*\lambda/\pi$, where n is an integer greater than one and $\lambda$ is the wavelength of the radiation for which the antenna is designed.

4. A low profile antenna as claimed in claim 3, wherein n is selected from the group consisting of 3 and 4.

5. A low profile antenna as claimed in claim 4, wherein the height of the antenna is 0.2 to 0.4$\lambda$.

6. A low profile antenna as claimed in claim 5 suitable for mobile satellite communications and having a high gain at elevation angles of 20 to 60 degrees.

7. A low profile antenna as claimed in claim 1, wherein the helical loop is wound about an imaginary cone such that the upper and lower diameters of the loop are tuned approximately to the highest and lowest operational frequencies of the antenna.

8. A low profile antenna as claimed in claim 7, wherein the angle of inclination of the walls of the imaginary cone is about 10 to 20°.

9. A low profile antenna as claimed in claim 1, wherein at least one additional antenna element is interleaved with said first-mentioned antenna element.

10. A low profile antenna as claimed in claim 1, wherein at least one additional antenna element is interleaved with said first-mentioned antenna element.

11. A method of making a low profile antenna comprising the steps of forming a wire into a helical loop having a plurality of overlapping turns, and spacing said overlapping turns sufficiently closely to provide a sufficiently strong coupling between adjacent said overlapping turns to force the current in all said closely spaced turns to be in phase such that each turn of said helical loop behaves as a traveling-wave loop antenna.

12. A method as claimed in claim 11, wherein the pitch angle of said helical loop is about 1 to 2 degrees.

13. A method as claimed i claim 11, wherein the diameter of the helical loop is given by the expression $D=n*\lambda/\pi$, where n is an integer greater than one and $\lambda$ is the wavelength of the radiation for which the antenna is designed.

14. A method as claimed in claim 13, wherein n is selected from the group consisting of 3 and 4.

15. A method as claimed in claim 14, wherein the height of the antenna is 0.2 to 0.4$\lambda$.

16. A method as claimed in claim 14, wherein the helical loop is wound about an imaginary cone such that the upper and lower diameters of the loop are tuned approximately to the highest and lowest operational frequencies of the antenna.

17. A method as claimed in claim 16, wherein the angle of inclination of the walls of the imaginary cone is about 10 to 20°.

18. A method as claimed in claim 11, wherein at least one additional loop is interleaved with said first-mentioned loop to increase the uniformity of current distribution about the antenna.

19. A low profile antenna as claimed in claim 9, wherein said additional antenna element is fed through a splitter such that the current in said additional antenna element is in phase with the current in said first-mentioned antenna element.

* * * * *